United States Patent [19]

Ash

[11] 4,081,869

[45] Apr. 4, 1978

[54] INFANT'S CRADLE HOLDER

[76] Inventor: Richard Graham Ash, 59 The Serpentine, Avalon Beach, New South Wales, Australia

[21] Appl. No.: 764,692

[22] Filed: Feb. 1, 1977

[51] Int. Cl.[2] ..... A47D 9/00

[52] U.S. Cl. ..... 5/105; 5/101; 297/274

[58] Field of Search ..... 5/101, 104, 105, 108, 5/258; 297/274, 287, 288, 377

[56] References Cited

U.S. PATENT DOCUMENTS

| | | | |
|---|---|---|---|
| 517,286 | 3/1894 | Meekins | 5/104 |
| 2,672,916 | 3/1954 | Kenney | 297/287 |
| 2,688,997 | 9/1954 | Miller | 5/105 |
| 3,004,793 | 10/1961 | Loomis | 297/274 |
| 3,538,522 | 11/1970 | Adams | 297/377 |

*Primary Examiner*—Casmir A. Nunberg
*Attorney, Agent, or Firm*—Stevens, Davis, Miller & Mosher

[57] ABSTRACT

A holder for an infant's cradle consists of a platform on which a cradle may be rested and retained, and a spring mounting for the platform which permits the platform to be rocked, somewhat in trampoline fashion, by the child's own exertion or that of the parent. The mounting comprises two U-shaped spring members each having one limb as part of a floor support for the holder, and a second limb adjustably securable within longitudinal socket tubes fixed on the sides of the platform.

2 Claims, 3 Drawing Figures

INFANT'S CRADLE HOLDER

The object of this invention is to provide a simple holder for an infant's cradle (of basket, bassinette or like type) which:

(a) enables the infant, by kicking its legs or other body movement, to elicit from the holder an enjoyable, trampoline-like motion response, (b) can be readily adjusted to suit the weight of the infant and at the same time enable the cradle to be disposed horizontally, when the infant is to go to sleep, or inclinedly elevated when the child is awake and wants to look about, and (c) can be gently rocked by the parent to help the infant to go to sleep, or to amuse or soothe it.

An example of the invention is illustrated by the drawings herewith.

Figure 1:
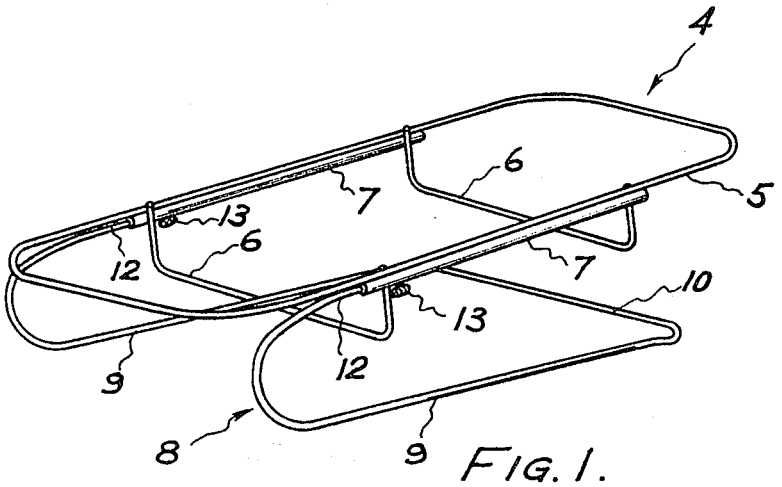
FIG. 1 is a perspective view of a cradle holder.
Figure 2:
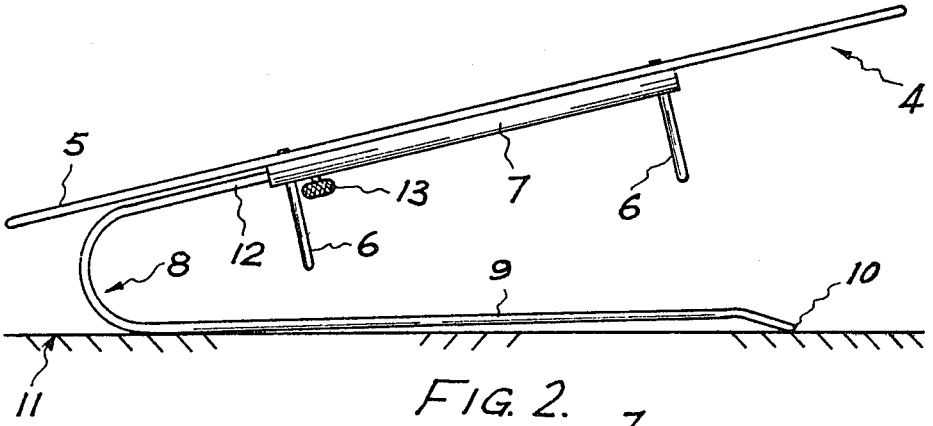
FIG. 2 is a side elevation of the same holder.
Figure 3:
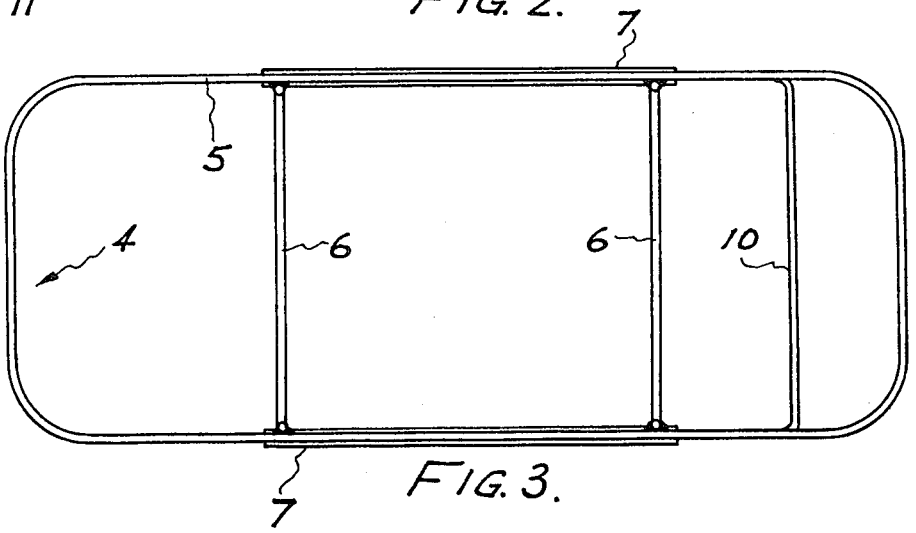
FIG. 3 is a plan projected from FIG. 2.

Referring to the drawings, platform 4 consists of a substantially rectangular frame 5 and at least two U-shaped floor bars 6 which depend from and are fixed to the frame 5. A cradle may be rested on the bars 6, being located in that placement by the frame 5, and then retained in that placement by the frame.

A pair of socket tubes 7 are fixed to the sides of frame 5 so to extend longitudinally of the platform.

A mounting 8 for the platform consists of two U-shaped portions each comprising first limbs 9 joined by cross-bar 10 so to form a base able to rest on a floor 11 or other support surface; and second limbs 12 able to be freely and respectively inserted in socket tubes 7.

Means to retain selected adjustment of the second limbs 12, relative to the socket tubes may consist of thumbscrews 13 which thread through the socket tubes and may thus be brought to bear tightly against the inserted second limbs 12.

The mounting 8 is made of spring steel or like resilient rod-like material; that is, actual rod or tube.

I claim:

1. An infant's cradle holder comprising:

(a) a platform upon which an infant's cradle may be located, rested and retained, and which consists of a rectangular frame and at least two floor bars fixed to and depending from said frame, (b) two socket tubes respectively fixed to the sides and extending longitudinally of said frame, (c) a platform mounting, of resilient rod-like material, comprising a pair of U-shaped members having first limbs forming part of a base able to rest on a support surface, and second limbs adapted to be freely and respectively inserted in the socket tubes, and (d) means to retain selected adjustment of said second limbs within said socket tubes.

2. A holder according to claim 1 wherein the said second limbs have their free ends joined by a cross-bar.

* * * * *